US008267272B2

(12) United States Patent
Seline

(10) Patent No.: US 8,267,272 B2
(45) Date of Patent: Sep. 18, 2012

(54) VENTED CONTAINER AND METHOD OF MANUFACTURING

(75) Inventor: David W. Seline, Strongsville, OH (US)

(73) Assignee: Avery Dennison Corporation, Pasadena, CA (US)

( * ) Notice: Subject to any disclaimer, the term of this patent is extended or adjusted under 35 U.S.C. 154(b) by 552 days.

(21) Appl. No.: 12/496,694

(22) Filed: Jul. 2, 2009

(65) Prior Publication Data

US 2010/0001001 A1 Jan. 7, 2010

Related U.S. Application Data

(60) Provisional application No. 61/077,959, filed on Jul. 3, 2008.

(51) Int. Cl.
*B65D 51/16* (2006.01)

(52) U.S. Cl. ..... 220/203.03; 220/371; 220/373; 220/202; 215/261; 215/348

(58) Field of Classification Search ..... 220/371, 220/373, 202, 203, 226, 203.03, 203.08, 220/203.01, 258.3, 256.1, DIG. 27, 89.1, 220/89.2; 215/371, 246, 247, 248, 261, 260, 215/270, 348, 362
See application file for complete search history.

(56) References Cited

U.S. PATENT DOCUMENTS

| | | | | |
|---|---|---|---|---|
| 3,961,724 | A * | 6/1976 | Kapsy | 220/371 |
| 4,134,535 | A * | 1/1979 | Barthels et al. | 383/102 |
| 4,136,796 | A | 1/1979 | Dubois et al. | |
| 4,884,716 | A * | 12/1989 | Steiner | 220/202 |
| 5,988,426 | A | 11/1999 | Stern | |
| 6,886,579 | B2 | 5/2005 | Stein et al. | |

FOREIGN PATENT DOCUMENTS

| | | |
|---|---|---|
| EP | 0 337 677 | 10/1989 |
| EP | 0 752 376 | 10/2000 |
| GB | 1 146 972 | 3/1969 |

* cited by examiner

*Primary Examiner* — Anthony Stashick
*Assistant Examiner* — Jeffrey Allen
(74) *Attorney, Agent, or Firm* — Avery Dennison Corporation

(57) ABSTRACT

A venting device that may be used directly with a container or via a vent cap for a container, includes a venting mechanism having one or more collapsible dome structures and an absorbent material to prevent leakage of liquid or flowable contents from within the container. The construction relies on a combination of venting domed structures and expandable absorbent material to seal one or more openings in a container and or cap.

9 Claims, 5 Drawing Sheets

VENTED CONTAINER AND METHOD OF MANUFACTURING

CROSS-REFERENCE TO RELATED APPLICATION

This application claims priority from U.S. Provisional Patent Application No. 61/077,959 filed on Jul. 3, 2008, entitled "Vented Container and Method of Manufacturing," which application is assigned to the same assignee as this application and whose disclosure is incorporated by reference herein in its entirety.

FIELD OF THE INVENTION

The present invention relates to a container, or a cap for a container, which includes a venting mechanism that precludes the leakage of liquid or other flowable contents, e.g. particulates, from the container.

BACKGROUND OF THE INVENTION

The problem of container deformation in response to pressure differences existing between the inside of a closed container and the ambient pressure is well known in the packaging industry. Such container deformation may be non-recoverable for certain container materials, such as some rigid or semi-rigid structures made of plastics or metals. Thin-walled, flexible or partially flexible containers can be particularly sensitive to the problem.

While not wishing to be bound to any particular theory, there are a number of possible factors which may lead to the existence of the pressure differences between the interior and the exterior of the container mentioned above. The contents of the container may, for example, be chemically unstable or may be sensitive to certain contaminants such as might occur in a reaction between the gases which may exist in the head space of the container and the contents of the container, or alternatively, in certain specific circumstances, where the contents of the container may react with the container material itself. Any chemical reactions involving the contents may lead to either production of gases, and hence to overpressure in the container, or to the absorption of any head space gases thereby causing under pressure in the container. In addition, the solid contents may absorb moisture, such as created by condensation due to temperature differentials and become soggy or saturated.

Pressure differences between the pressure inside the container and the ambient atmospheric pressure may also occur when the temperature during the filling and sealing of the container is significantly different from external temperature during shipment, transportation and storage. Another possibility of a pressure difference may be caused by a different ambient pressure at the filling of the container from another ambient pressure at a different geographical location.

The prior art has proposed several solutions using valve systems which avoid pressure differences between the interior and the exterior of the container. Proposed solutions also relate to various venting caps which allow pressure generated inside the container to be released by escape of gas. U.S. Pat. No. 4,136,796 and EP 0 752 376 disclose self venting closures having a gas-permeable membrane covering an orifice to the exterior atmosphere. These membranes are made of a material which is impermeable to liquids, but permeable to gases. Therefore, these containers may have apertures to release gas to the exterior without losing their leak-tightness. U.S. Pat. No. 5,988,426 and EP 337677 disclose a vented lid that relies on a hydrophobic material to allow passage of air through the vent hole and prevent the passage of liquids through the vent hole. Another example U.S. Pat. No. 6,886,579 relies on a ball bearing mechanism to seal the vent and prevent spillage of liquid contents. Additionally, GB 1 146 972 discloses a venting cap to be fitted onto the mouth of a container. It allows the passage of gases while preventing passage of liquids through the venting membrane. This is achieved by choosing the size of the pores in the membrane.

The use of membranes in these applications can add a considerable expense to the venting system. Tests have shown that when containers are heated to sufficient temperature to cause internal pressures to develop, leakage through the membrane occurs. In the case of mechanical closures, these devices can also add complexity and cost to the vent system and can suffer from malfunction and breakage of the mechanical components. Therefore the need exists for a container for a flowable product such as liquid or particulate, or a cap for such a container, which allows venting of the container while preventing the leakage of the flowable contents from the container even under conditions where internal pressures exist.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention relates to a container, or a cap that may be used a container, which includes a venting means and at the same time prevents leakage of liquid or other flowable contents from within the container.

In one embodiment of the presently described invention, a perforated cap structure is placed atop a vent hole that extends from the interior of a container to the exterior of the container, that is completely through the container wall. This cap is sealably affixed to the container wall. On top of the vented hole a dome like structure is positioned and is preferably constructed of a flexible, impervious material. The dome structure has an internal area and a radially extending venting area and a further radially extending external flange area. The flange area is fastened to the container in such a way so as to maintain coverage of the vent by the internal area of the dome. The venting area of the dome is located so as to not overlie the vent hole. The venting area of the dome has perforations sufficient to allow air flow through the dome. On top of the dome is positioned a porous expandable absorbent, which has an upper surface and a lower surface, so as to fill the area within the cap, but not to exert pressure upon the dome. The dome is positioned adjacent the lower surface. On top of the domed structure and the absorbent material is a perforated rigid cap that is sealably attached to the surface of the container. Thus, in a situation of normal usage or storage where the contents of the container were of higher pressure than the external atmosphere, gasses from within the container would flow through the vent hole, through the venting area of the dome, around and through the absorbent material and finally through the perforated area of the cap. Splashing or sloshing of the liquid or other flowable contents during use or shipment or handling is anticipated. Minor amounts of liquid splashing into the vent hole would be contained in the domed structure and would then drain back into the container. In situations of abnormal usage or storage wherein the liquid or other flowable contents of the container are brought in direct and prolonged contact with the vent hole, the contents would pass through the venting area of the dome and be absorbed into the expandable absorbent. Once moistened by the liquid, the absorbent would expand against the perforated cap and collapse the dome structure from a first open position to a second closed position, thereby pressing the interior area of the dome into direct contact with the vent hole and sealing the vent hole to further leakage.

In a further embodiment of the presently described invention, an additional domed structure is placed within the cap structure, on top of the perforations in the cap. That is, the invention may include first and second domed structures that move between a first open position and a second closed position. Upon expansion of the absorbent material, both the domed structures are collapsed and placed in direct contact with the vent hole and perforated area in the cap. As a result, the area between the container and the cap are sealed and isolated and leakage of the liquid material from the construction is prevented.

In yet another embodiment of the presently described invention, the venting device is preassembled and is sealably attached to the container such that the venting device overlies the vent hole in the container. In this case a dome like structure of flexible impervious material that has an internal area and a radially external venting area and a further radially extending external flange area is prepared. On top of the dome is placed a porous expandable absorbent so as to fill the area within the cap, but not to exert pressure upon the dome. On top of the domed structure and the absorbent material is a perforated rigid cap that is sealably attached to the flange area of the dome. The venting device can then be sealably attached to the container.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the exemplary embodiments of the invention in conjunction with the accompanying drawings, of which.

DETAILED DESCRIPTION OF THE INVENTION

The present invention is now illustrated in greater detail by way of the following detailed description which represents the best presently known mode of carrying out the invention. However, it should be understood that this description is not to be used to limit the present invention, but rather, is provided for the purpose of illustrating the general features of the invention.

Figure 1:
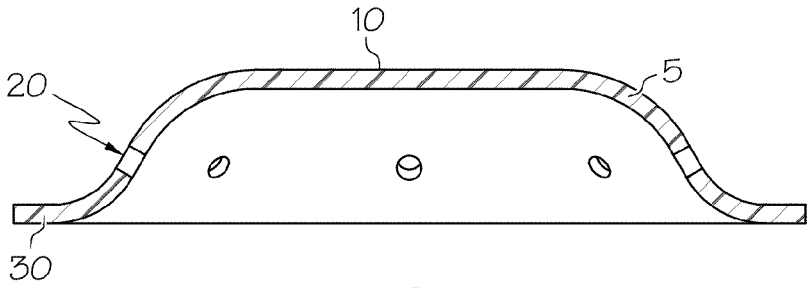
FIG. 1 is a perspective view depicting one version of a dome structure.

Referring to FIG. 1, a perforated dome structure 5 is shown to have an internal area 10 and a radially extending external perforated venting area 20 and a further radially extending external flange area 30.

Figure 2:
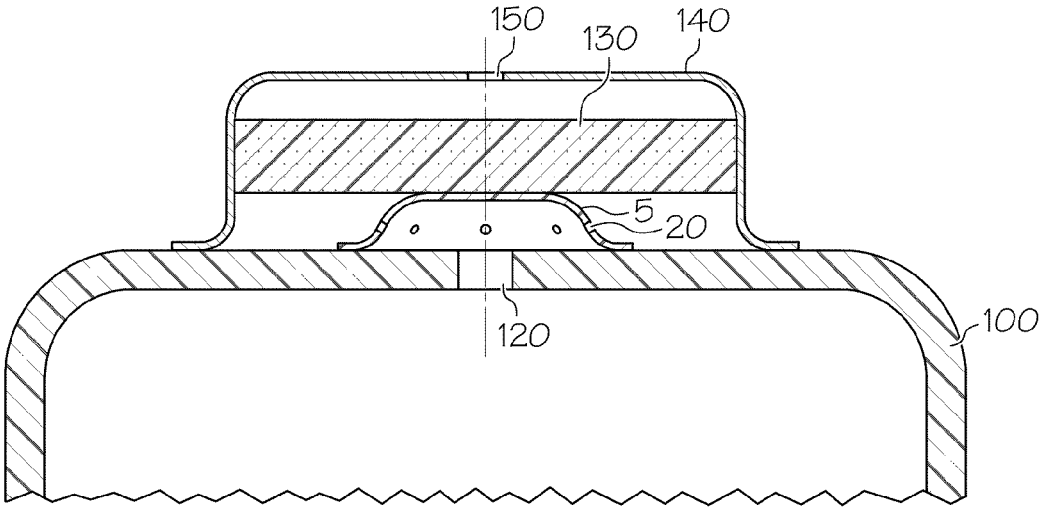
FIG. 2 is a perspective view of one embodiment of the presently described invention illustrating a dome structure and absorbent material configuration.

FIG. 2 provides a vented container 100 that includes a vent 120. On top of this vent 120 is affixed a domed structure 5. A flange area 30 is fastened to the container 100, such as by adhesive, sonic welding, in mold or the like, in such a way as to maintain coverage of the vent 120 by the internal area 10 of the dome. The venting area of the dome 20 is located such as to not cover or block the vent hole 120. On top of the dome 5 is placed a porous expandable absorbent 130. The absorbent 130 has an upper and lower surface and the dome 5 is positioned against the lower surface. Placed on top of the absorbent material 130 and attached to the container 100 is a rigid cap 140 with at least one perforation or opening 150.

Figure 3:
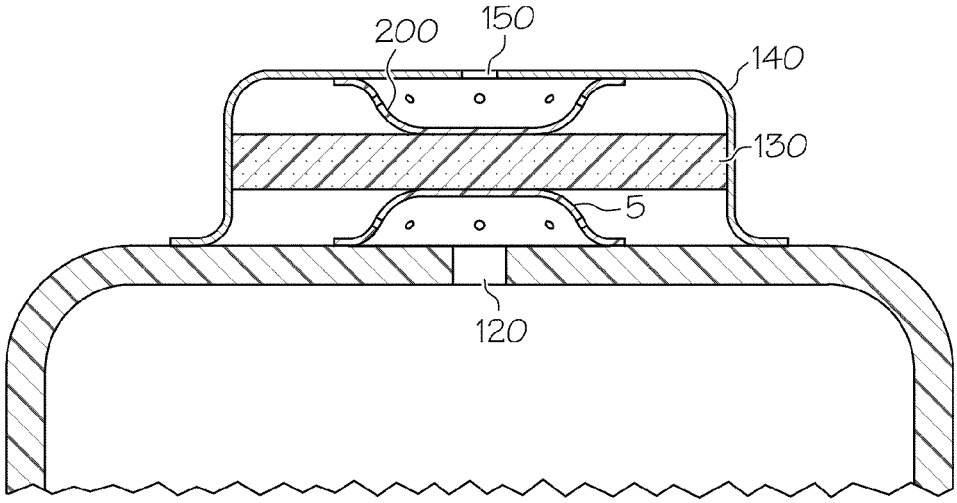
FIG. 3 is a perspective view of yet a further embodiment of the presently described invention providing a plural domed structure.

Reference is now directed to FIG. 3, where an additional or second domed structure 200 is used in the container construction. The additional dome 200 is positioned immediately beneath the opening 150, and adjacent the upper surface of the absorbent 130 so as to provide a further closure mechanism when the absorbent material expands to prevent either leakage of the contents or seepage from the environment. As seen from FIG. 3, the second domed structure 200 is placed in an inverted position when compared to the first domed structure 5. Each of the first and second domed structures, 5 and 200, respectively, can move between a first open position and second closed position.

The domed structure 5 is positioned to ensure that surface or flange 20 of the domed structure 5 does not come in cover or obscure the vent 120 until such time as the absorbent material 130 swells due to liquid contact and causes the dome 5 to collapse over the vent 120 thereby sealing the vent 120 from further leakage.

Figure 4:
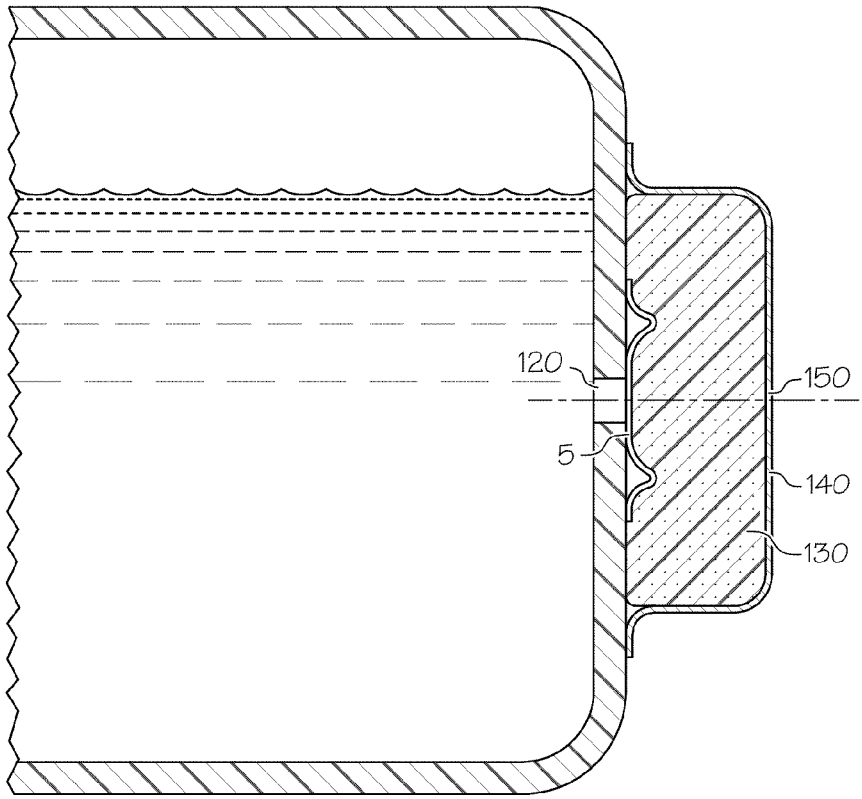
FIG. 4 is a perspective view of one embodiment of the presently described invention where the absorbent layer has expanded, crushing the dome structure and sealed the container from further leakage.

FIG. 4, illustrates the container construction provided in FIG. 2, showing the container closure after subjecting it to abnormal use conditions so that the expandable absorbent 130 has absorbed the leaking liquid and has expanded in order to collapse the domed structure 5 to a second closed position from a first open position shown in FIGS. 2 or 3. The pressure exerted by the absorbent material causes the dome 5 to come in direct contact with vent hole 120 so as to prevent further leakage of the liquid contents of the container. The second position of the domed structure is substantially flat and forms a generally planar configuration with the top of the container on which it is seated.

Figure 5:
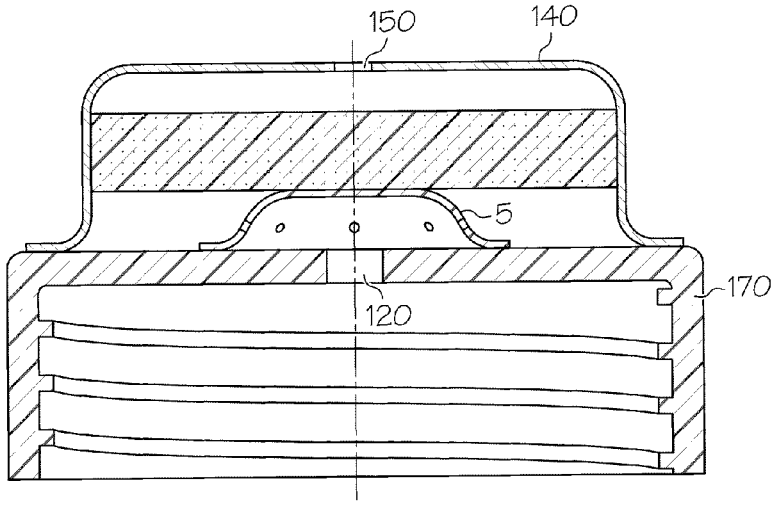
FIG. 5 is a perspective view of yet a further embodiment where the vent device is constructed as a screw cap for attachment to a container.

Referring to FIG. 5, the vent device is constructed as a screw cap 170 for the container showing a series of threads to fasten the cap 170 to the container. While FIG. 5 provides only a single domed structure 5, it should be understood that a plural domed structure as provide in FIG. 3 could be provided.

Figure 6:
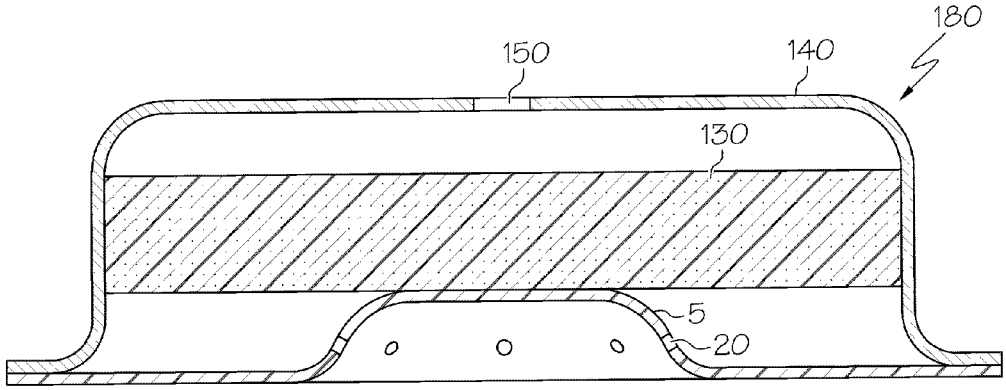
FIG. 6 is a perspective view of an embodiment where the vent device is a stand alone device that can subsequently be attached to a container.
Figure 7:
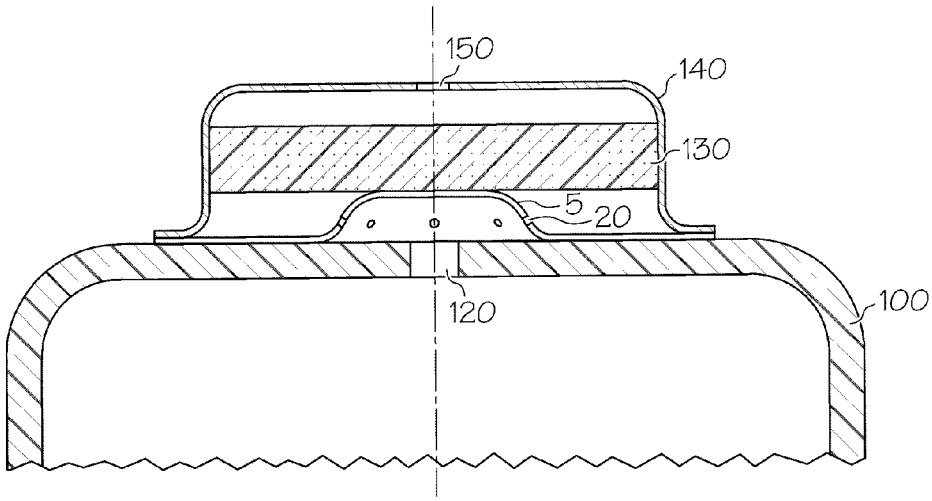
FIG. 7 is a perspective view of the stand alone vent device attached to a container.

Reference is now directed to FIG. 6 and 7, the vented device is constructed as a preassembled unit 180 which can then be sealably attached to a container 100 such that it overlies the vent hole 120 in the container.

The absorbent material 130 provided in the exemplary embodiments of the presently described invention, can be of any material that expands when exposed to the liquid contents of the container. One example of such a material is compressed cellulose available from either (a) "The Color Wheel Company", Philomath, Oreg. under the Trade Name of "Miracle Sponges" or (b) "The Absorene Manufacturing Company Inc", St. Louis, Mo. under the Trade Name of Cellulose Discs. Another example of a suitable material for use with the present invention is a non-woven construction that is impregnated with super absorbent polymer available from Scapa North America of Windsor, Conn. under the product designations including WSD-244, L-550 and WSD-252. These materials were used in sufficient layers such that upon expansion of the materials, sufficient pressure was exerted on the domed structure so as to create a seal.

In order to compare materials provided in the prior art with those of the current invention, a test protocol was embraced. To simulate hair care products, ten ounce plastic bottles were filled to 90% of their volume with 3% hydrogen peroxide. In the case of non-woven materials and micro porous films, the test materials were affixed to the inside surface of a cap. This cap had a 16" hole placed in its top surface. The cap was then attached to the bottle. In the case of the current invention, the constructions of FIG. 2 and FIG. 3 were tested. The bottles were then inverted to expose the test materials to the liquid contents of the bottle. The bottles, still in the inverted position, were then placed in an oven at 50° C. for twenty hours and observed for leakage.

The porous non-wovens tested were (a) product codes 18007, 12085, 17509 and 26402 from Alstrom of Windsor Locks, Conn.; and (b) product codes DP3930-100H and DP5001-140P from Delstar of Middletown, Del. The micro porous films tested were (a) product codes AC38 from Clopay of Mason, Ohio and (b) product codes PM-I020 and PM-3V for Mupor PTFE from Porex of Fairport, Ga. All of the non-wovens and films listed above did not pass the twenty hour test. Only the constructions of this invention passed the test by not allowing any of the liquid contents of the bottle to exit the container.

Figure 8:
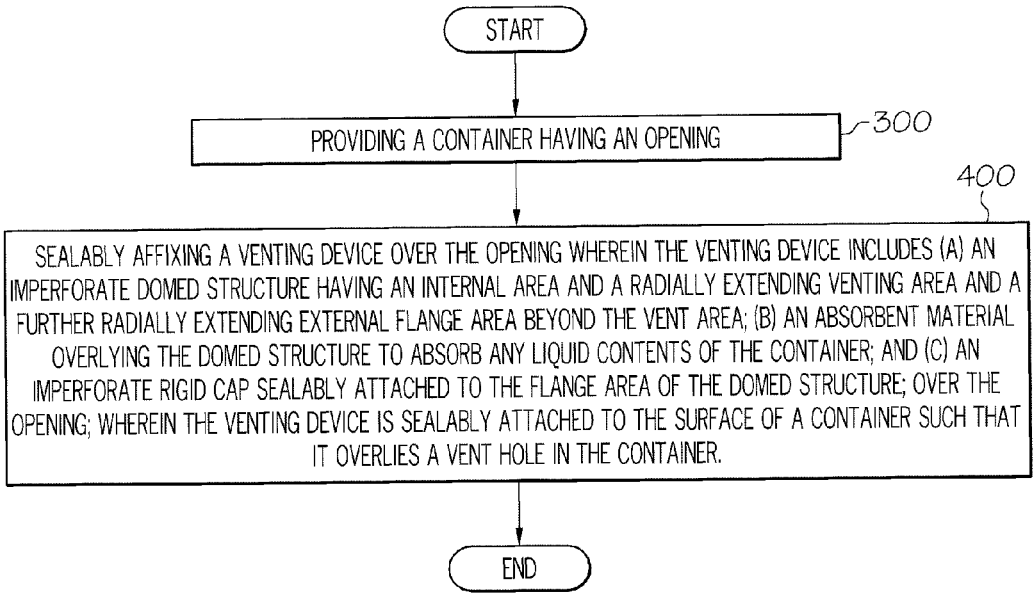
FIG. 8 provides a block diagram of an exemplary method for making a vented container.

An exemplary method of making a vented container is illustrated in FIG. 8. A method is described wherein at step 300, a container 100 is provided and at step 400 a venting device 180 is sealably attached to the container. The venting device including: (a) a perforated domed structure that has an internal area and a radially extending venting area and a further radially extending external flange area beyond the vent area; (b) an absorbent material overlies the domed structure to absorb any liquid contents of the container; and (c) a perforated rigid cap is sealably attached to the flange area of the domed structure; over the opening and the venting device is sealably attached to the surface of a container such that it overlies a vent hole in the container.

Figure 9:
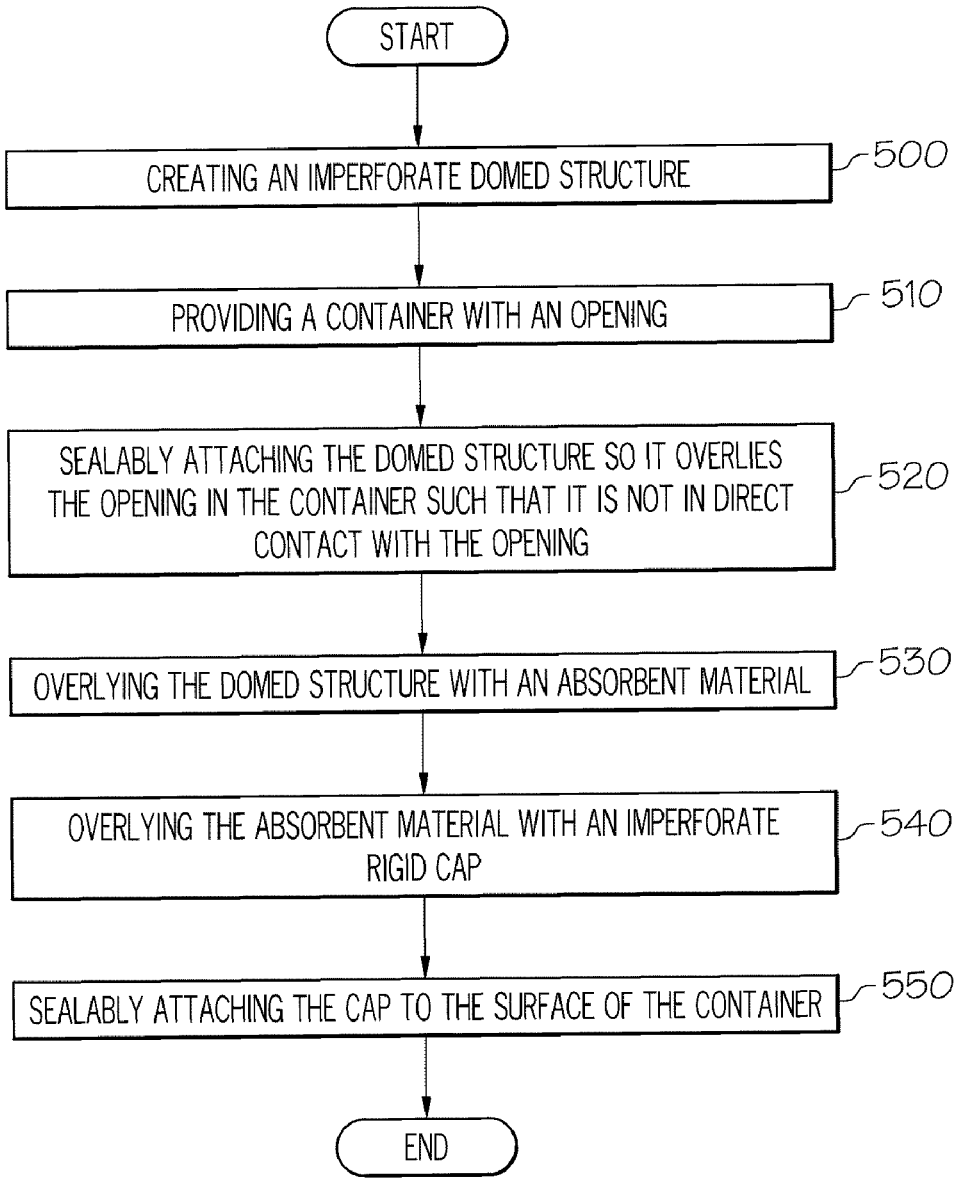
FIG. 9 is a flow chart of another exemplary method of making a vented container.

Another exemplary method for making a vented container is illustrated in FIG. 9. A method is described wherein at step 500 a perforated domed structure 5 is created and at step 510 a container 100 is provided. At step 520 the domed structure is sealably attached to the container so that the domed structure overlies the opening 120 and is not in direct contact with the opening, that is the domed structure does not block the opening. At step 530 an absorbent material 130 is placed so as to overly the domed structure and at step 540 a perforated rigid cap 140 is placed so as to overly the absorbent material. At step 550 the cap is sealably attached to the surface of the container.

It will thus be seen according to the present invention a highly advantageous vented container has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A venting device for a container comprising:

a perforated rigid cap sealably attached to a surface of a container;

the container having an opening;

at least a first perforated domed structure sealably attached to a surface of the container and overlying the opening in the container such that it is not blocking the opening, the perforated domed structure is contained within the rigid cap;

the perforated domed structure having a first open position and a second closed position;

an absorbent material having upper and lower surfaces and contained within the rigid cap overlying the domed structure, such that the domed structure is adjacent the lower surface of the absorbent material;

and wherein the absorbent material is expandable upon contact with liquid contents of the container to change the perforated dome structure from the first position to the second position that is generally planar with the surface of the container.

2. The venting device as recited in claim 1, wherein the domed structure is provided with a peripheral flange extending outwardly from the opening in the container.

3. The venting device as recited in claim 1, wherein the rigid cap is provided with threads.

4. The venting device as recited in claim 1, wherein a second domed structure is provided and placed adjacent the upper surface of the absorbent material and beneath the rigid cap.

5. The venting device as recited in claim 4, wherein upon swelling of the absorbent material, a second seal is formed against the rigid cap with the second domed structure, so as to prevent leakage of the absorbed liquid through the rigid cap.

6. The venting device as recited in claim 4, wherein the second domed structure is placed in an inverted position with respect to the first domed structure.

7. The venting device as recited in claim 1, wherein the absorbent material is selected from a group including compressed cellulose and non-woven materials.

8. The venting device as recited in claim 7, wherein the absorbent material is impregnated with an absorbent polymer.

9. The venting device as recited in claim 1, wherein the perforated domed structure is sealed to the surface of the container by one of adhesive, sonic welding or molding.

* * * * *